United States Patent [19]

French

[11] Patent Number: 4,813,609

[45] Date of Patent: Mar. 21, 1989

[54] SPRAY NOZZLE

[76] Inventor: Floyd R. French, 700 Shallowford, Manchester, Mo. 63021

[21] Appl. No.: 12,498

[22] Filed: Feb. 9, 1987

[51] Int. Cl.[4] ..... B05B 7/30

[52] U.S. Cl. ..... 239/311; 239/316; 239/318; 239/376

[58] Field of Search ..... 239/310, 311, 316, 318, 239/325, 376, 379, 345, 377, 378; 222/559, 561, 630

[56] References Cited

U.S. PATENT DOCUMENTS

| | | | |
|---|---|---|---|
| 1,734,164 | 11/1929 | Faber | 239/379 |
| 1,866,620 | 7/1932 | Chesnut | 239/376 |
| 2,188,366 | 1/1940 | Lindstaedt | 239/310 |
| 2,264,539 | 12/1941 | Lindstaedt | 239/310 |
| 2,601,672 | 6/1952 | Gatchet | 239/311 |
| 2,682,428 | 6/1954 | Roberts | 239/311 |
| 3,897,004 | 7/1975 | French | 239/318 |
| 4,637,531 | 1/1987 | Olsson | 222/559 |

FOREIGN PATENT DOCUMENTS

| | | | |
|---|---|---|---|
| 441436 | 1/1936 | United Kingdom | 239/311 |
| 509182 | 7/1939 | United Kingdom | 239/318 |

*Primary Examiner*—Andres Kashnikow
*Assistant Examiner*—Karen B. Merritt
*Attorney, Agent, or Firm*—Senniger, Powers, Leavitt and Roedel

[57] ABSTRACT

A one-piece spray nozzle for the metered mixing and dispensing of a carried fluid with a primary carrier fluid comprising a first connection for connecting the nozzle to a source of the carried fluid and a second connection adapted for carrying the nozzle to a source of the primary carrier fluid. A jet passageway communicating with the second connection projects the primary carrier fluid in a stream. A mixing chamber is aligned with the jet passasgeway but is separated from the jet passageway by an air gap or recess. A passage extending between the first connection and the mixing chamber conducts the carried fluid under gravity to the mixing chamber. The mixing chamber is sized so that the stream of the primary carrier fluid does not contact the walls of the mixing chamber but draws a stream of a secondary carrier fluid from the air gap or recess through the mixing chamber. The stream of the secondary carrier fluid draws the carried fluid into the chamber to mix with the primary carrier fluid.

19 Claims, 2 Drawing Sheets

SPRAY NOZZLE

BACKGROUND OF THE INVENTION

This invention relates to spray nozzles, and in particular to a spray nozzle bottle cap for the metered mixing and dispensing of a concentrated carried fluid from the bottle with a primary carrier fluid via a secondary carrier fluid.

Spray nozzles for mixing a concentrated carried fluid with a carrier fluid are known. These devices often include their own reservoir for the carried fluid and are usually adapted to be connected to a garden hose to mix and dispense the carried fluid with water. Such devices are widely used to apply fertilizers, fungicides, insecticides, toxicants, soaps, detergents, and numerous other solutions.

Many of the nozzles are complex and include large number of parts. Consequently these nozzles are relatively expensive, and generally too expensive to be considered disposable. Because of the toxicity of some of the chemicals dispensed and because the complex nozzles can be difficult to clean, a household might have several different nozzle devices for the various different chemicals used around the house. This is expensive and can present difficulties in storing the equipment safely and securely.

The inventor has previously invented a spray nozzle bottle cap which is disclosed in his prior U.S. Pat. No. 3,897,004. This prior spray nozzle was a significant improvement over the available nozzles because it was a very simple one-piece nozzle that was inexpensive enough to provide as a disposable bottle cap. The inventor's prior nozzle thus provided a readily available, easy to use nozzle that eliminated the cleaning and storage problems of the more complicated prior nozzle devices. The nozzle made a variety of common chemical products inexpensively accessible to any household, even to those without spray equipment.

The inventor's prior nozzle, although a significant improvement over the available nozzles, required some precision in manufacture to ensure proper alignment and contact between the stream of carrier fluid and the passageway supplying the carried fluid. This required precision increased the cost of the device. One other disadvantage was that the nozzle had no means for shutting off the flow through the nozzle.

SUMMARY OF THE INVENTION

Among the objects of the present invention is the provision of a simple, inexpensive spray nozzle for the metered mixing and dispensing of a concentrated carried fluid with a carrier fluid; the provision of such a nozzle that does not require precise alignment of the primary carrier fluid stream and the carried fluid supply passage by utilizing a secondary carrier fluid; the provision of such a nozzle that can be made inexpensively to be economically disposable; the provision of such a device that can be provided as a cap for a container of a concentrated fluid to permit the fast and convenient dilution and dispensing of the fluid without special equipment; the provision of such a spray nozzle with a positive air gap anti-suckback feature; the provision of such a spray nozzle that can provide a solid stream discharge or a spray discharge; and the provision of a spray nozzle that can provide a clear water rinse. It is also an object of at least one embodiment of this invention to provide a spray nozzle with means for shutting off the flow of fluid through the nozzle.

Generally, the spray nozzle of this invention comprises first connection means adapted for connecting the nozzle to a source of the carried fluid, a second connection means adapted for connecting the nozzle to a source of a primary carrier fluid under pressure, and a jet passageway in communication with the second connection means for projecting the primary carrier fluid in a stream. The nozzle further comprises a mixing chamber aligned with the jet passageway to receive the stream of the primary carrier fluid, the chamber being separated from the jet passageway by an air gap or recess. A passage extends between the first connection means and the mixing chamber for conducting the carried fluid under gravity from the source to the mixing chamber. The internal dimensions of the mixing chamber are sufficiently larger than the stream of the primary carrier fluid projected through the mixing chamber that the stream of the primary carrier fluid does not contact the walls of the mixing chamber and thus the stream of the primary carrier fluid draws a stream of a secondary carrier fluid from the air gap or recess through the mixing chamber. The secondary carrier fluid stream in the chamber draws the carried fluid from the passage into the chamber to mix with the stream of the primary carrier fluid. In the preferred embodiment the primary carrier fluid is water and the secondary carrier fluid is air.

In an alternate embodiment of the nozzle, the nozzle includes means for selectively shutting off the stream of the primary carrier fluid from the jet passageway. In the preferred embodiment this means comprises a shutoff member received in the air gap or recess between the jet passageway and the mixing chamber, the shutoff member being operable between a closed position wherein the shutoff member blocks the passage of the primary carrier fluid from the jet passageway to the mixing chamber, and an open position wherein the shutoff member does not block the passage of the primary carrier fluid from the jet passageway to the mixing chamber.

Thus, the nozzle of the present invention is simple and inexpensive and provides for the metered mixing and dispensing of a concentrated carried fluid with a carrier fluid. The nozzle utilizes a secondary carrier fluid (air) drawn into the mixing chamber by the primary carrier fluid to educt the carried fluid and therefore does not require precise alignment of the primary carrier fluid stream and the carried fluid supply passage. The nozzle can be made inexpensively to be economically disposable, and can even be provided as a cap for a container of a concentrated fluid. The nozzle provides convenient dilution and dispensing of the fluid without special equipment. The nozzle has an air gap or recess that prevents the carried fluid from being sucked into the primary carrier fluid supply. The nozzle can provide a solid stream or spray discharge. When the nozzle is inverted it mixes the carried fluid with the carrier fluid, when the nozzle is upright it provides a clear rinse. Finally, the nozzle can be provided with means for selectively shutting off the fluid stream.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENTS

Figure 2:
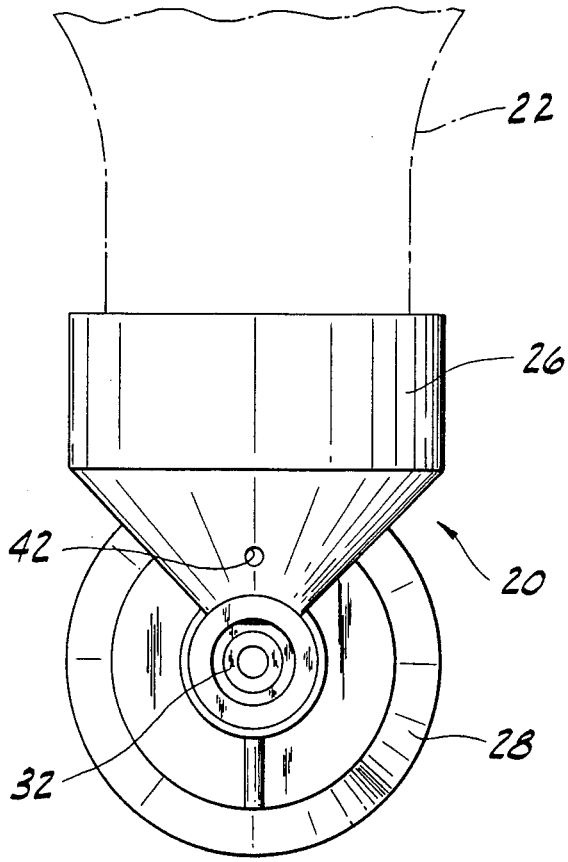
FIG. 2 is an enlarged front elevation view of the inverted spray nozzle, showing the container in phantom.
Figure 1:
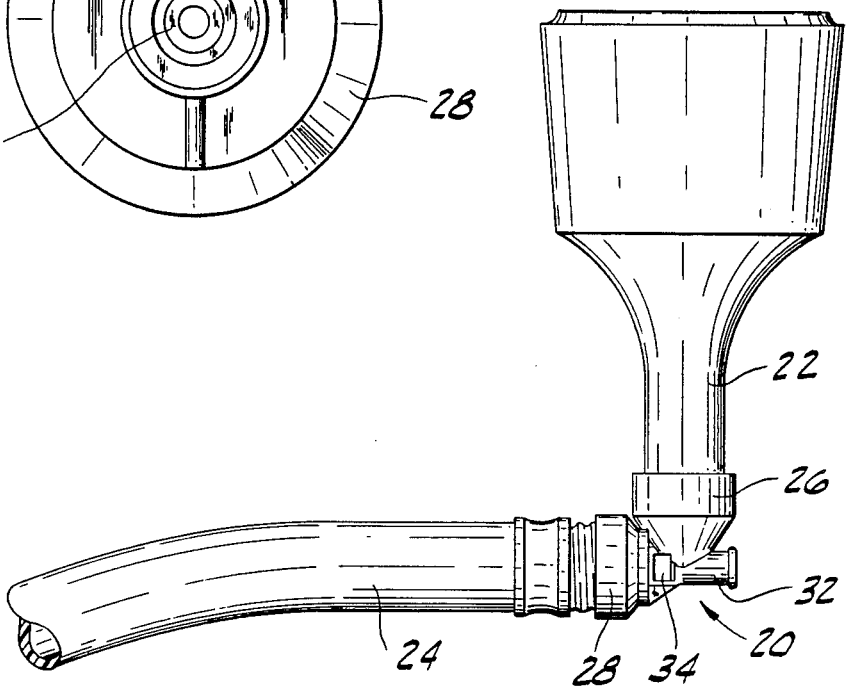
FIG. 1 is a side elevation view of a spray nozzle constructed according to the principles of this invention as it would be mounted to a container of a concentrated carried fluid and connected to a hose, showing the spray nozzle inverted.
Figure 3:
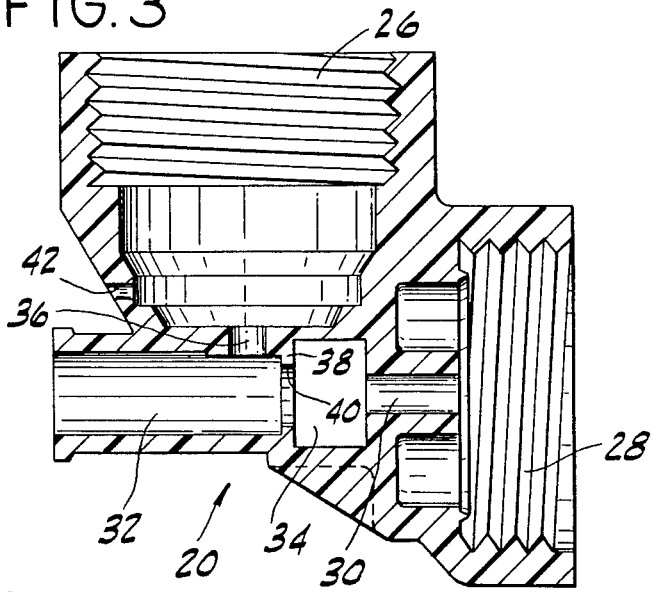
FIG. 3 is a longitudinal cross sectional view in the vertical plane of the inverted spray nozzle.

A first embodiment of a spray nozzle constructed according to the principles of this invention is indicated generally as 20 in FIGS. 1–3. The nozzle 20 is adapted to be mounted on the top of a container 22 filled with a concentrated carried fluid and to be attached to a hose 24, supplying a carrier fluid (typically water) under pressure. In the preferred embodiment the primary carrier fluid is water and the secondary carrier fluid is air, however the invention is not so limited, and it is possible that other primary or secondary carrier fluids could be used. In FIGS. 1 and 2 the container and nozzle are shown inverted, which is their normal operating position for mixing and dispensing the carried fluid.

The nozzle 20 is adpated to be inexpensively made, for example by injection molding from a suitalbe polymeric material. Any number of materials that can be molded and do not react with the chemicals being dispensed can be used. The nozzle could even be cast from metal, but this would increase the cost.

The nozzle 20 comprises first connection means, which in the preferred embodiment is an internally threaded socket 26, for connecting the nozzle to the container 22 filled with the concentrated carried fluid. The nozzle also comprises a second connection means, preferably a second internally threaded socket 28, for connecting the nozzle to the hose 24 supplying the primary carrier fluid. As shown best in FIG. 3, a jet passageway 30 communicates with the second socket and is adapted to project the primary carrier fluid in a solid stream. The jet passageway is preferrably cylindrical, and is long enough to establish a smooth fluid flow therein, establishing a predominantly laminar flow pattern as the jet exits into the air gap or recess. The dimensions of the jet passageway to establish the desired flow depends upon the fluid pressure at the inlet of the jet passageway and the viscosity of the carrier fluid. In the preferred embodiment, where the carrier fluid is water provided at a pressure of between about 35 and about 75 psig, the ratio of length to diameter is between about 1.5:1 and 10:1, and preferably between about 2:1 and 3:1. The inventor has empirically determined that the desired diameter for the majority of the municipal water systems is between about 0.10 inch and 0.2 inches, and preferably between 0.120 and 0.140 inches.

A mixing chamber 32 is aligned with the jet passageway 30 to receive the stream of the primary carrier fluid projected from the jet passageway. The mixing chamber is separated from the jet passageway by the air gap or recess 34. The air gap or recess 34 may be any shape, but as shown in the drawings is preferably square for ease of manufacture.

A passage 36 extends between the first socket 26 and the mixing chamber 32. When the container is inverted to its operating position as shown in FIGS. 1 and 2, the passage 36 conducts the concentrated carried fluid under gravity from the container to the mixing chamber. The passage has the function of metering the carried fluid into the carrier fluid. The appropriate size is empirically determined for a desired mixing ratio. For example, when using a 0.125 inch jet passageway 0.300 inches long, with water at 50 psig as the carrier fluid, mixing ratios of between 15:1 and 30:1 can be obtained with passage diameters of between about 0.090 and about 0.140 inches. These diameters are much larger than used in prior metering devices and can be easily molded, eliminating expensive manufacturing steps. Other mixing ratios can be obtained by varying the passage diameter.

The mixing chamber can be of any cross section, for example, square, octagonal, or oval, but is preferably circular. The internal dimensions of the chamber are sufficiently larger than the stream of the primary carrier fluid projected through the mixing chamber that the stream of the first carrier fluid does not contact the walls of the mixing chamber. In the preferred embodiment, the diameter of the mixing chamber is between about 1.5 and about 5 times the diameter of the jet passageway, and is preferably between about 2 and about 3 times the diameter of the jet passageway. The ratio of the length to the diameter of the mixing chamber is preferably between about 1:1 to about 3:1. The upstream end of the mixing chamber may be provided with a collar 38 to ensure that the carrier fluid does not impinge on passage 36. Collar 38 has a generally central aperture 40 through which the stream of the primary carrier fluid passes. The aperture 40 is sufficiently large that the stream does not splatter on the collar. In the preferred embodiment, aperture 40 has a diameter of between about 50% and about 95% of the diameter of the mixing chamber and is preferably between about 70% and about 85% of the diameter. The downstream end of the mixing chamber can be provided with a member (not shown) as is known in the art for dispersing the stream into a spray, if a spray application is desired.

The stream of the primary carrier fluid draws a stream of air from the air gap or recess through the mixing chamber. The air stream acts as a secondary carrier fluid, that can draw the carried fluid from container 22 through the passage 36 into the chamber to mix with the stream of the primary carrier fluid. When the nozzle 20 and the container 22 are inverted, the suction of the secondary carrier fluid is sufficient to draw the carried fluid from the container 22 into the mixing chamber. An air bleed hole 42 is provided in the nozzle adjacent to the socket 26 to allow air to enter the container to replace the concentrated carried fluid withdrawn, thereby facilitating smooth operation. The hole 42 must be large enough to allow air to enter the container to replace the carried fluid at the rate it is educted, while minimizing fluid leakage. It has been empirically determined that a 1/16 inch hole is satisfactory, although other sizes may be satisfactory depending upon the particular carried fluid.

The sockets 26 and 28 are preferably similarly threaded, complementary to threads on the top of the container 22 so that either of the sockets can be secured over the top of the container. Furthermore, the threads of the second socket 28 are preferably complementary to the threads on a standard garden hose, so that it can be connected to the garden hose.

Figure 4:
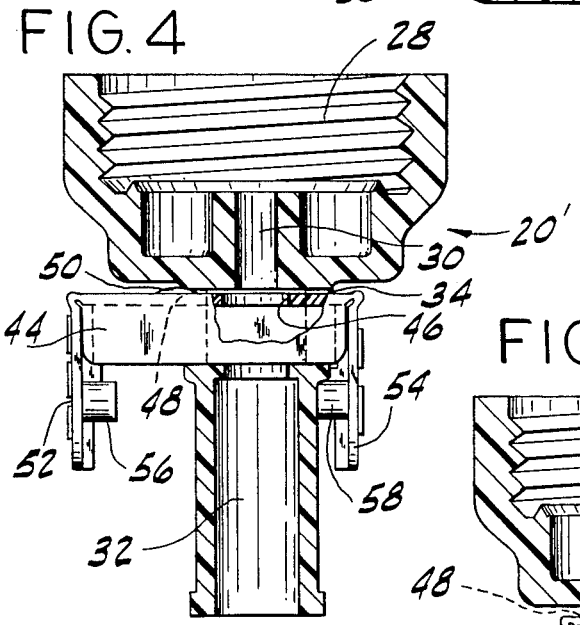
FIG. 4 is a longitudinal cross sectional view in the horizontal plane of a second embodiment of the spray nozzle with a shutoff member in the air gap or recess, showing the shutoff member in the open position.
Figure 5:
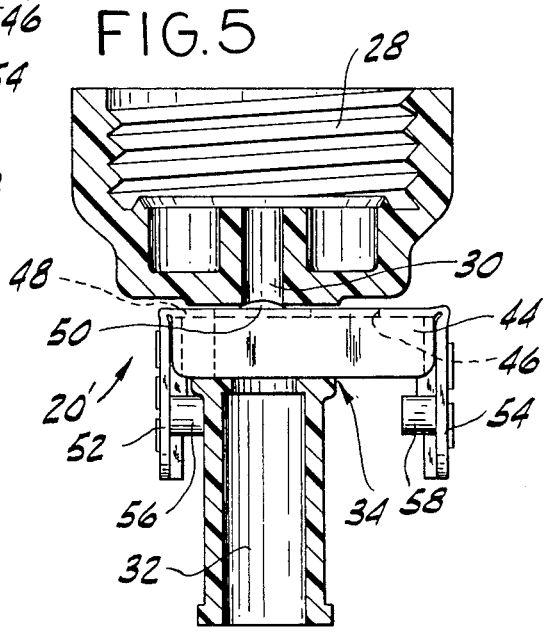
FIG. 5 is a longitudinal cross sectional view in the horizontal plane of the spray nozzle of the second embodiment, showing the shutoff member in the closed position.

A second embodiment of the nozzle is shown in FIGS. 4 and 5 and indicated as 20'. Nozzle 20' is similar to nozzle 20, and corresponding parts are identified with the same reference numerals. Nozzle 20' differs from nozzle 20, however, by the provision of a shutoff member 44, which is received in the air gap or recess 34. The shutoff member 44 has a generally channel-shaped cross section with the open top of the channel oriented forwardly with respect to the nozzle. The shutoff member has an aperture 46 therein which, as shown on FIG. 4, can be aligned with the jet passageway 30 to allow the stream of the primary carrier fluid to pass to the mixing chamber 32. The open portions of the shutoff member permit the stream of primary carrier forced to draw the secondary carrier fluid into the mixing chamber. The aperture 46 must be large enough to receive the stream from the jet passageway without any contact by the shutoff member. The aperture is preferably slightly larger than the jet passageway to accommodate misalignments due to molding variations. In the preferred embodiment, the aperture is 1.75 times the diameter of the jet passageway. The shutoff member also has a solid portion 48, preferably provided with a convex boss 50, which as shown in FIG. 5 can be aligned with the jet passageway 30 to block the stream of the primary carrier fluid. The convex boss provides a sealing force sufficient to overcome the fluid pressure. The shutoff member 44 is wedged in the air gap or recess and blocks the jet passageway. The convex boss, which projects into the jet passageway, also provides a positive snap action, confirming that the shutoff member is in the closed position. The shutoff member thus allows the nozzle to be turned off, if desired. The shutoff member also serves to close and seal the container when the second socket is secured over the container, as might be done in shipping.

The opposite ends of the shutoff member 40 are provided with stops 52 and 54 to retain the shutoff member in the air gap or recess. Stops 52 and 54 can be conveniently formed by bending the ends of the shutoff member after it is inserted into the air gap or recess. Stops 52 and 54 may have studs 56 and 58, respectively, for providing a positive positioning of the shutoff member in the closed and open positions.

OPERATION

The nozzle 20 can be provided separately with a container 22 of a concentrated carried fluid, or preferably as the cap for the container. When nozzle 20 is provided as the cap, a gasket (not shown) can be provided to seal the container 22. During shipping, socket 28 is preferably secured over the top of the container. This is particularly true with nozzle 20', since the shutoff member 44 can then provide a closure for the container without a gasket.

To dispense the concentrated carried fluid, socket 28 is detached from the top of the container and socket 26 is attached in its place. A typical garden hose 24, connected to a supply of water under pressure, is then connected to the socket 28 of the nozzle. When the water supply is turned on the nozzle projects the water in a stream. The water stream draws air from the air gap or recess through the mixing chamber. When the container and the nozzle are inverted, the concentrated carried fluid is conducted to the mixing chamber through passage 36 under gravity. The air drawn through the mixing chamber acts like a secondary carrier fluid creating enough suction to draw the concentrated carried fluid from the passage 36 into the mixing chamber. Air to replace the concentrated carried fluid being withdrawn can enter through the air bleed hole 42. Once in the mixing chamber the concentrated carried fluid mixes with the primary carrier fluid (the water) and the nozzle dispenses a mixture of water and the carried fluid. When the container and nozzle are again righted, the nozzle projects a clear stream of water. This gives the nozzle a rinsing capability which is of particular advantage, for example, if the nozzle is being used to dispense a detergent or other cleaning preparation.

If nozzle 20' is used, the shutoff member 40 can be operated to selectively block the flow from the jet passageway. This allows the nozzle to be shut off as desired. The stops provide a positive action between the open and closed positions, to ensure proper operation.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A spray nozzle for attachment to the top of a container of a concentrated carried fluid for the metered mixing and dispensing of the carried fluid with a primary carrier fluid, the nozzle comprising:

a body having first connection means for connection to the top of the container; second connection means for connection to a source of primary carrier fluid, a recess in the body in communication with the atmosphere; a jet passageway interconnecting the second connection means and the recess for projecting the primary carrier fluid in a stream; a mixing chamber extending from the recess opposite from the jet passageway is jetted across the recess and through the mixing chamber; and a passage for delivery of the carried fluid from the first connection means into the mixing chamber by inverting the container to which the body is connected;

the internal dimensions of the mixing chamber being sufficiently larger than the stream of the primary carrier fluid projected through the mixing chamber that the stream of the primary carrier fluid does not contact the wall of the chamber and draws a stream of air from the recess through the mixing chamber, the air stream in the chamber drawing the carried fluid from the passage into the chamber to mix with the stream of the primary carrier fluid.

2. The nozzle according to claim 1 further comprising an air bleed hole to allow air to enter the container to replace the carried fluid withdrawn from the container.

3. The nozzle according to claim 1 further comprising a collar on the upstream side of the mixing chamber, the collar having an opening therein through which the stream of the primary carrier fluid passes.

4. The nozzle according to claim 1 wherein the nozzle is molded from a polymeric material.

5. The nozzle according to claim 1 wherein the first and second connection means comprise threaded sockets.

6. A nozzle according to claim 1 wherein the jet passageway has a length at least twice the diameter of the passageway.

7. A nozzle according to claim 1 wherein the mixing chamber has a inside diameter roughly twice the diameter of the jet passageway.

8. A nozzle according to claim 1 wherein the passage is separated from the jet passageway by at least 6 mm.

9. The nozzle according to claim 1 wherein the body is one-piece molded plastic.

10. The nozzle according to claim 1 wherein the first connection means is a threaded socket.

11. The nozzle according to claim 1 wherein the second Connection means is a threaded socket.

12. A spray nozzle for attachment to the top of a container of concentrated carried fluid for the metered mixing and dispensing of the carried fluid with a primary carrier fluid, the nozzle comprising:

first connection means adapted for connecting the nozzle to the top of the container;

second connection means adapted for connecting the nozzle to a source of primary carrier fluid;

a jet passageway in communication with the second connection means to project the primary carrier fluid in a stream;

a mixing chamber aligned with the jet passageway to receive the stream of the primary carrier fluid, the mixing chamber being separated from the jet passageway by an air gap open to the atmosphere;

a passage extending between the first connection means and the mixing chamber for conducting the carried fluid under gravity from the container to the mixing chamber when the container is inverted;

the internal dimensions of the mixing chamber being sufficiently larger than the stream of the primary carrier fluid projected through the mixing chamber that the stream of the primary carrier fluid does not contact the walls of the chamber and draws a stream of air from the gap through the mixing chamber, the air stream in the chamber drawing the carried fluid from the passage into the chamber to mix with the stream of the primary carrier fluid; and means for selectively shutting off the stream of primary carrier fluid from the jet passageway comprising a shutoff member received in the air gap between the jet passageway and the mixing chamber, being operable between a closed position wherein the shutoff member blocks the passage of the primary carrier fluid from the jet passageway to the mixing chamber, and an open position wherein the shutoff member does not block the passage of the primary carrier fluid from the jet passageway to the mixing chamber.

13. In combination, a container having an opening in the top and filled with a concentrated carried fluid for dilution and dispensing with a primary carrier fluid, and a spray nozzle for the metered mixing and dispensing of the carrier fluid with the primary carrier fluid, the nozzle comprising:

first connection means adapted for connecting the nozzle to the top of the container;

second connection means adapted for connecting the nozzle to a source of primary carrier fluid;

a jet passageway in communication with the second connection means to project the primary carrier fluid in a stream;

a mixing chamber aligned with the jet passageway to receive the stream of the primary carrier fluid, the mixing chamber being separated from the jet passageway by an air gap open to the atmosphere;

a passage extending between the first connection means and the mixing chamber for conducting the carried fluid under gravity from the container to the mixing chamber when the container is inverted;

the internal dimensions of the mixing chamber being sufficiently larger than the stream of the primary carrier fluid projected through the mixing chamber that the stream of the primary carrier fluid does not contact the walls of the chamber and draws a stream of air from the gap through the mixing chamber, the air stream in the chamber drawing the carried fluid from the passage into the chamber to mix with the stream of the primary carrier fluid; and means for selectively shutting off the stream of primary carrier fluid from the jet passageway comprising a shutoff member received in the air gap between the jet passageway and the mixing chamber, being operable between a closed position wherein the shutoff member blocks the passage of the primary carrier fluid from the jet passageway to the mixing chamber, and an open position wherein the shutoff member does not block the passage of the primary carrier fluid from the jet passageway to the mixing chamber.

14. A spray nozzle for attachment to the top of a container of a concentrated carried fluid for the metered mixing and dispensing of the carried fluid with water from a hose, the nozzle comprising:

a one piece molded plastic body having a first threaded socket for connection to the top of the container; and a second threaded socket for connection to a water hose; a recess in the body in communication with the atmosphere; a jet passage way interconnecting the second socket and the recess for projecting water in a stream; a mixing chamber extending from the recess opposite the jet passageway and aligned with the jet passageway so that the water stream delivered through the jet passageway is jetted across the recess and through the mixing chamber; a passage for delivery of the carried fluid from the first socket into the mixing chamber by inverting the container to which the body is connected;

the internal dimensions of the mixing chamber being sufficiently larger than the water stream projected through the mixing chamber that the water stream does not contact the wall of the chamber and draws a stream of air from the recess through the mixing chamber, the air stream in the chamber drawing the carried fluid from the passage into the chamber to mix with the water stream.

15. The nozzle according to claim 14 further comprising a shut off member reciprocally received in the recess in the body, the shut off member being operable to reciprocate in the recess between a closed position in which the shut off member blocks the water stream from passing from the jet passageway to the mixing chamber and an open position in which the shut off member does not block the water stream from passing from the jet passageway to the mixing chamber.

16. The nozzle according to claim 15 wherein the shut-off member comprises an elongate stem adapted to reciprocate in the recess in the body, the stem having a transverse fold line spaced from each end permitting each end to be bent relative to the stem to form a stop for engaging the portions of the body adjacent the recess and retaining the shut-off member in the recess, and means for locking the ends of the stem in their bent orientation relative to the stem.

17. The nozzle according to claim 15 wherein both the first and second sockets are adapted to connect to the top of the container.

18. A spray nozzle for attachment to the top of a container of a concentrated carried fluid for the metered mixing and dispensing of the carried fluid with a primary carrier fluid, the nozzle comprising:

first connection means adapted for connecting the nozzle to the top of the container second connection means adapted for connecting the nozzle to a source of the primary carrier fluid or to the top of the container;

a jet passageway in communication with the second connection means to project the primary carrier fluid in a stream;

a mixing chamber aligned with the jet passageway to receive the stream of the primary carrier fluid, the mixing chamber being separated from the jet passageway by an air gap open to the atmosphere; and a passage extending between the first connection means and the mixing chamber for conducting the carried fluid under gravity from the container to the mixing chamber when the container is inverted;

the internal dimensions of the mixing chamber being sufficiently larger than the stream of the primary carrier fluid projected through the mixing chamber that the stream of the primary carrier fluid does not contact the walls of the chamber and draws a stream of air from the air gap through the mixing chamber, the air stream in the chamber drawing the carried fluid from the passage into the chamber to mix with the stream of the primary carrier fluid; and means for selectively closing the jet passageway to shut off the stream of the primary carrier fluid from the jet passageway when the second connection means is connected to a source of the primary carrier fluid and to close and seal the container when the second connection means is connected to the top of the container.

19. In combination, a container having an opening in the top and filled with a concentrated carried fluid for dilution and dispensing with a primary carrier fluid, and a one-piece spray nozzle for the metered mixing and dispensing of the carried fluid with the primary carrier fluid, the nozzle comprising:

first connection means adapted for connecting the nozzle to the top of the container second connection means adapted for connecting the nozzle to a source of the primary carrier fluid or to the top of the container;

a jet passageway in communication with the second connection means to project the primary carrier fluid in a stream;

a mixing chamber aligned with the jet passageway to receive the stream of the primary carrier fluid, the mixing chamber being separated from the jet passageway by an air gap open to the atmosphere; and a passage extending between the first connection means and the mixing chamber for conducting the carried fluid under gravity from the container to the mixing chamber when the container is inverted;

the internal dimensions of the mixing chamber being sufficiently larger than the stream of the primary carrier fluid projected through the mixing chamber that the stream of the primary carrier fluid does not contact the walls of the chamber and draws a stream of air from the air gap through the mixing chamber, the air stream in the chamber drawing the carried fluid from the passage into the chamber to mix with the stream of the primary carrier fluid; and means for selectively closing the jet passageway to shut off the stream of the primary carrier fluid from the jet passageway when the second connection means is connected to a source of the primary carrier fluid and to close and seal the container when the second connection means is connected to the top of the container.

* * * * *